US008516956B1

(12) United States Patent
Kanae

(10) Patent No.: US 8,516,956 B1
(45) Date of Patent: Aug. 27, 2013

(54) POWER DRILL OPERATED CAN CRUSHER

(76) Inventor: Clarence Kanae, Khei, HI (US)

( * ) Notice: Subject to any disclaimer, the term of this patent is extended or adjusted under 35 U.S.C. 154(b) by 406 days.

(21) Appl. No.: 12/825,409

(22) Filed: Jun. 29, 2010

(51) Int. Cl.
*B30B 13/00* (2006.01)
*B30B 9/32* (2006.01)
*B30B 1/18* (2006.01)

(52) U.S. Cl.
USPC ..... 100/35; 100/215; 100/226; 100/245; 100/902

(58) Field of Classification Search
USPC ..... 100/35, 226, 245, 289, 902
See application file for complete search history.

(56) References Cited

U.S. PATENT DOCUMENTS 1,187,118 A * 6/1916 Williamson ..... 100/228
2,965,258 A * 12/1960 Wilson et al. ..... 29/243.519
3,062,130 A 11/1962 Huber et al.
3,889,587 A 6/1975 Wharton
4,095,459 A * 6/1978 Feldt ..... 73/76
4,216,713 A 8/1980 Jung
4,290,584 A * 9/1981 Eckels et al. ..... 254/380
4,570,536 A 2/1986 Dodd
4,970,951 A * 11/1990 Katz ..... 100/289
5,048,413 A 9/1991 Deiters
5,176,072 A 1/1993 Larson
5,857,407 A * 1/1999 Gross et al. ..... 100/125
5,899,141 A * 5/1999 Gross et al. ..... 100/37
6,076,455 A 6/2000 Geise
6,923,114 B2 8/2005 Koch
7,552,676 B1 * 6/2009 Johnson ..... 100/289

* cited by examiner

*Primary Examiner* — Jimmy T Nguyen
(74) *Attorney, Agent, or Firm* — Montgomery Patent & Design; Robert C. Montgomery

(57) ABSTRACT

A power drill-operated can crusher comprises a frame, a plate, and a screw drive mechanism. The frame comprises a hollow cylindrical structure having an inner radius sized to contain a standard aluminum can and an opening on a bottom end for the insertion of an aluminum can into the interior of the frame. The plate comprises a rigid circular plate with radius equal to the inner radius of the frame. The screw drive mechanism comprises a screw mechanism which produces a linear mechanical action of the plate via rotational motion of the screw mechanism. The plate is connected inside the frame and parallel to the circular faces of the frame via the screw drive mechanism. The top end of the screw drive mechanism comprises a power drill adapter, which allows a user to rotate the mechanism with a standard power drill. To use the apparatus, a user places the plate in a high position within the frame, places an aluminum can in the bottom of the frame, engages the screw mechanism with a power drill in order to drive the plate downwards and flatten the can, and reverses the screw action to replace the plate in a high position, thereby allowing the flattened can to be removed from the frame.

15 Claims, 6 Drawing Sheets

POWER DRILL OPERATED CAN CRUSHER

RELATED APPLICATIONS

The present invention was first described in a notarized Official Record of Invention on Sep. 11, 2009, that is on file at the offices of Montgomery Patent and Design, LLC, the entire disclosures of which are incorporated herein by reference.

FIELD OF THE INVENTION

The present invention relates generally to recycling, and in particular, to an apparatus adapted for the automatic crushing of aluminum cans in conjunction with an existing power drill.

BACKGROUND OF THE INVENTION

With society's increasing awareness of the dwindling supply of natural resources and overflowing landfills, many communities are providing and mandating recycling services to their residents. The benefits of these efforts have already begun to be seen and will continue to be realized in the future. However, as with most beneficial programs, these efforts are accompanied by some burdens. One (1) of these burdens is that the bulk of recycled materials consist of various containers such as beverage cans, steel cans, and plastic containers, and there is much wasted space present from the air in the containers. As such, a user must empty the said recycling container on a frequent basis since it tends to fill rapidly, thus leading to additional frustration. Another common practice is to crush or otherwise compact recyclable containers prior to placing them in a designated container. However, in many situations, a multitude of such containers must be dealt with simultaneously. Common problems include fatigue on the part of a user during this process as well as the inability of crushing by hand to achieve a desired level of compaction.

Various attempts have been made to provide device which assist in the crushing and compaction of recyclable containers. Examples of these attempts can be seen by reference to several U.S. Pat. No. 3,889,587, issued in the name of Wharton, describes a can crusher. The Wharton device provides an operating handle for leverage in crushing a can which a user has pre-provided with a slit along an outer surface to achieve full compaction.

U.S. Pat. No. 4,570,536, issued in the name of Dodd, describes an electrically actuated can crusher. The Dodd apparatus provides a powered means for compacting a can or the like.

U.S. Pat. No. 6,076,455, issued in the name of Geise, describes an aluminum can compacting mechanism including a handle for providing increased mechanical advantage to a user during a can crushing operation.

While these devices fulfill their respective, particular objectives, each of these references suffer from one (1) or more of the aforementioned disadvantages. Many such devices are not automatic in the sense that prolonged use presents a physical hardship to a user. In addition, many such devices are not utilizable in a plurality of desired locations such as garages, picnic sites, and the like, due to lack of power sources, difficulty in transport, and the like. Accordingly, there exists a need for a recyclable container compacting apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an apparatus which provides automatic and repeatable recyclable container compaction functions to a user in a manner which is simple, portable, and comfortable. Thus, the object of the present invention is to solve the aforementioned disadvantages and provide for this need.

To achieve the above objectives, it is an object of the present invention to provide a means for a user to crush cans or other objects in a powered manner via utilization of a common power drill. The apparatus comprises a frame, a crushing plate, inner and outer screw drive mechanisms, and a drill bit adaptor.

Another object of the present invention is to comprise a frame sized to integrally receive a common aluminum can. The frame comprises a hollow cylindrical structure of a material strong enough to withstand repeated crushing forces of housed containers.

Yet still another object of the present invention is to allow a user to easily insert cans via an insertion aperture along a top surface of the frame. The insertion aperture is sized to easily receive a common aluminum can.

Yet still another object of the present invention is to allow a user to easily remove crushed cans after compaction via a dispensing aperture along a bottom surface of the frame. The dispensing aperture is smaller in size compared to the insertion aperture such that the can or container is not dispensed until after it is compacted.

Yet still another object of the present invention is to provide attachment to an existing conventional power drill via the power drill adaptor.

Yet still another object of the present invention is to crush a housed can or container by actuation of an attached existing power drill. The drill rotates the drill adaptor and screw drive mechanisms which then translate the motion into a lateral motioning of the flat crushing plate, thereby compacting the housed container. Reverse motioning of the drill reverses the motion of the plate for subsequent reuse.

Yet still another object of the present invention is to provide a method of utilizing the device that provides a unique means of attaching the apparatus to an existing power drill via the drill adaptor, easily inserting a desired object for crushing via the insertion aperture, crushing the object via easy motioning of the crushing plate through normal operation of the drill, removing and depositing the device via the dispensing aperture, and resetting the apparatus for subsequent repeated use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
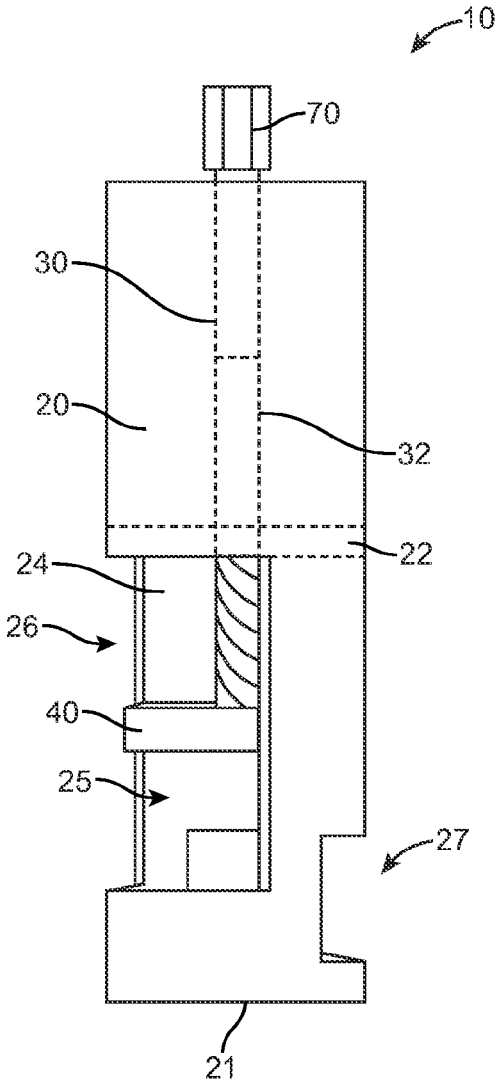
FIG. 1 is a perspective view of a power drill-operated can crusher 10 with a crushing plate 40 positionably advanced within a chamber 25, according to the preferred embodiment of the present invention.

10 power drill-operated can crusher
20 frame
21 stationary wall
22 fixed wall
24 internal wall
25 chamber
26 insertion aperture
27 dispensing aperture
30 inner screw drive mechanism
32 outer screw drive mechanism
35 guide hole
40 crushing plate
50 can
60 power drill
65 power drill chuck
70 power drill adapter

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that provides a means for a user to operably crush cans 50 or other objects via utilization of a common power drill 60. The power drill-operated can crusher (herein described as the "apparatus") 10 comprises a frame 20, a crushing plate 40, an inner screw drive mechanism 30, and an outer screw mechanism 32. The majority of the components incorporated within the apparatus 10 is envisioned to be fabricated with conventional metallic materials such as steel, aluminum, and/or combination of the two (2) preferably, but not essentially, coated in a suitable protection finish such as, but not limited to, paint to protect from corrosion. The apparatus 10 would best be manufactured using commonly known stamping and welding processes to construct the frame 20 and crushing plate 40 of the apparatus 10 assembling them to commonly manufactured components such as the screw drive mechanisms 30, 32. However, the apparatus 10 may be fabricated of any material with suitable qualities to withstand the crushing pressure and force being applied for successful crushing of the can 50. The apparatus 10 may be of any suitable size and dimension so long as it is capable of crushing a standard aluminum can 50. However, it is envisioned that the overall size and shape of the apparatus 10 is minimized so that said apparatus 10 may be easily installed thereto a power drill 60 of any size without any complication.

Referring now to FIG. 1, a perspective view of the apparatus, is disclosed according to the preferred embodiment of the present invention. The apparatus 10 comprises a frame 20 that is cylindrically shaped having an inner diameter sized to contain a standard aluminum can 50. The frame 20 is a continuous hollow cylinder with exception of two (2) apertures 26, 27 integrally formed therein for the insertion of a full-size can 50 and the dispensing of a crushed can 50 which will be explained later. The frame 20 is relatively cylindrical with a hollow center which designates an area or chamber 25 by which will removably receive an object desired to be crushed, i.e. an aluminum can 50. Please take note that for simplicity purposes, an aluminum can 50 will hereafter be described as the object to be crushed; however, it will be appreciated that multiple objects may be crushed with use of the apparatus 10 including, but not limited to: paper, cardboard juice boxes, trash, and more. The chamber 25 is cylindrically shaped as well to mimic the size and shape of a commonly known aluminum can 50 to aid in the secured containment of said aluminum can 50 before, during the action of, and after crushing said can 50. The chamber 25 in which the can 50 would be crushed is adequately sized to receive a full-sized aluminum can 50 therein. Further, internal walls 24 help contain the outward projection of the can 50 as it is being crushed. The can 50 is held within the frame 20 of the apparatus 10 between the interior surface walls 24 of the chamber 25 which is then contained until fully crushed upon which the crushed can 50 may then fall through the dispensing aperture 27 upon retraction of a crushing plate 40.

Figure 2:
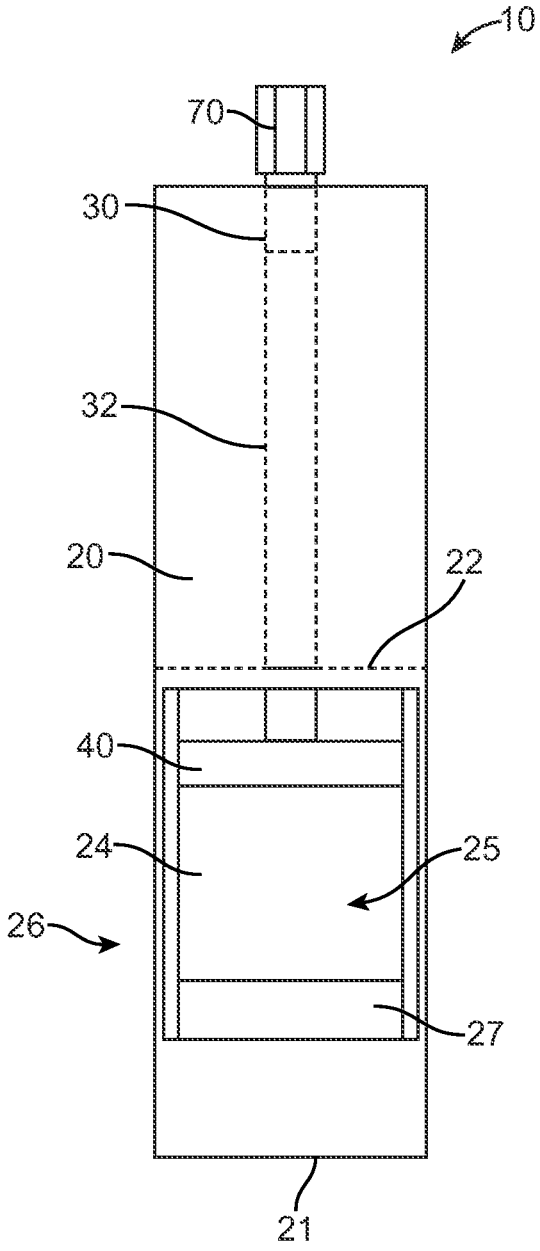
FIG. 2 is a top view of the power drill-operated can crusher 10 with the crushing plate 40 positionably advanced within the chamber 25, according to the preferred embodiment of the present invention.
Figure 3:
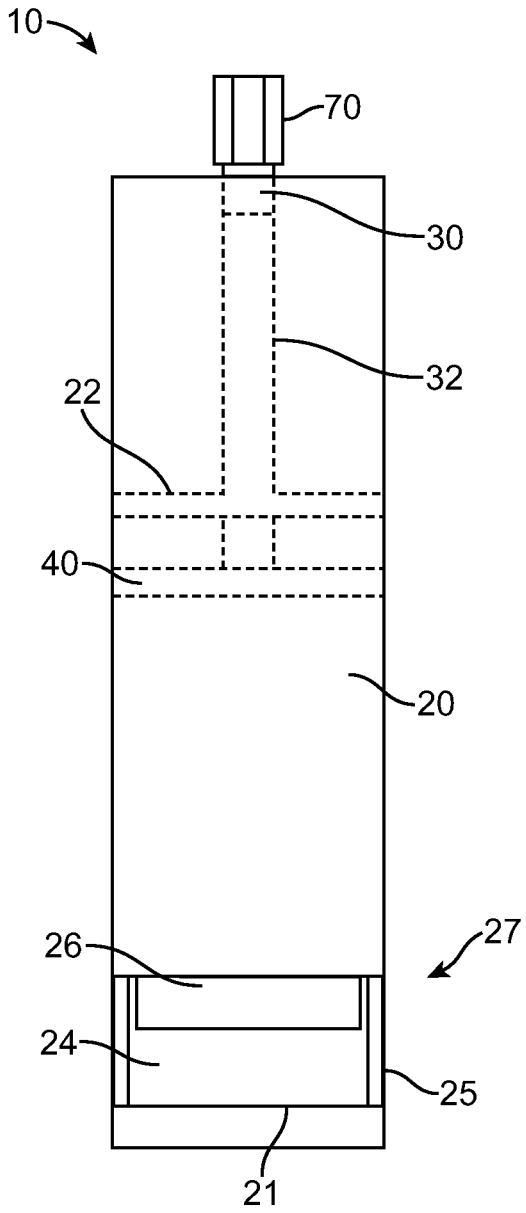
FIG. 3 is a bottom view of the power drill-operated can crusher 10, according to the preferred embodiment of the present invention.

Referring now to FIGS. 2 and 3, top and bottom views of the apparatus 10, are herein disclosed according to the preferred embodiment of the present invention. The frame 20 comprises two (2) apertures 26, 27, a can insertion aperture 26 and a crushed can dispensing aperture 27. Positioned on the top surface of the frame 20 is the can insertion aperture 26 for the insertion of an aluminum can 50 into the interior of the frame 20 within the chamber 25. A dispensing aperture 27 is smaller in size in comparison with the insertion aperture 26 to prevent an uncrushed can 50 from falling through. The original length of an aluminum can 50 prevents said can 50 from falling through the dispensing aperture 27 prior to compaction. The insertion aperture 26 is integral with the chamber 25 and sized so that an uncrushed can 50 may be placed within the chamber 25. The dispensing aperture 27 is integral with the chamber 25 and sized so that an uncrushed can 50 may not fall through until fully crushed. The dispensing aperture 27 is sized so that the linear distance from front to rear would be less than an uncrushed can 50 but greater than that of a crushed can 50. Thus, when an empty can 50 is loaded into the chamber 25 through the insertion aperture 26, it is still supported by the chamber 25 until the can 50 is crushed by the linear motion of a crushing plate 40 upon which the can 50 is then compressed to a size at which may fall via gravity through the dispensing aperture 27.

Figure 4:
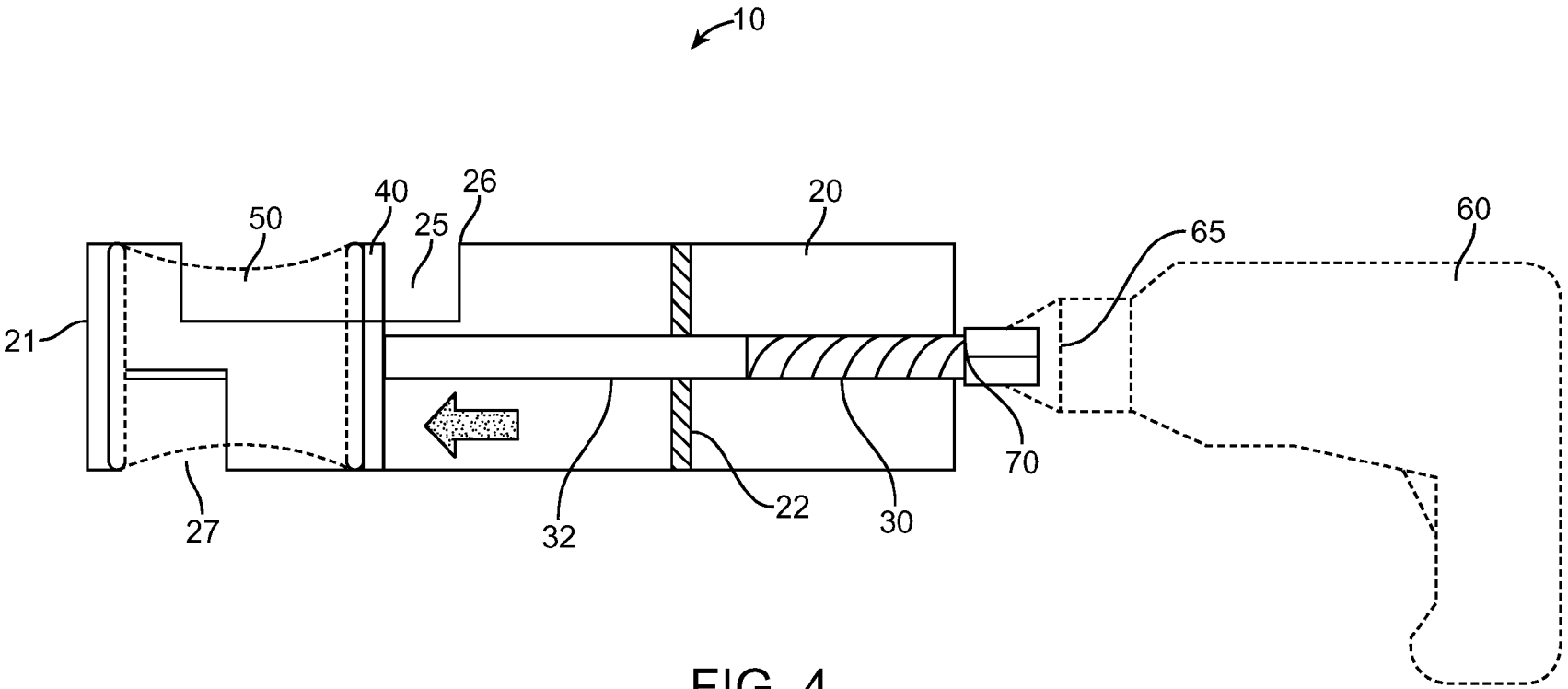
FIG. 4 is an internal side view of the power drill-operated can crusher 10 with a power drill 60 connected thereto advancing the crushing plate 40 to crush a can 50, according to the preferred embodiment of the present invention.
Figure 5:
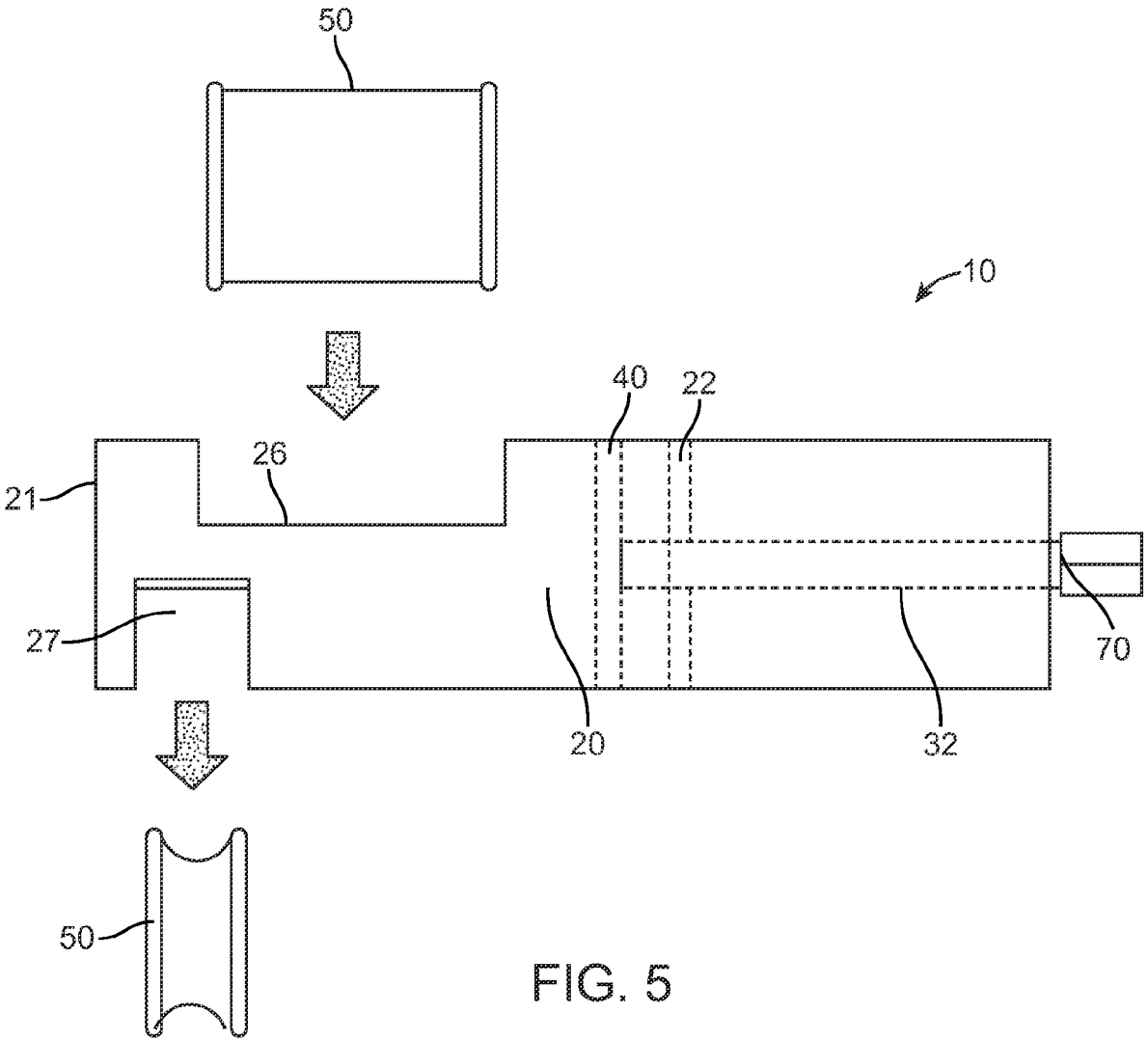
FIG. 5 is a side view of the power drill-operated can crusher 10 illustrating a full-size can 50 accessing chamber 25 through an insertion aperture 26 and a crushed can 50 departing therefrom chamber 25 through a dispensing aperture 27, according to the preferred embodiment of the present invention; and, FIG. 6 is a rear perspective view of the power drill-operated can crusher 10 with screw drive mechanisms 30, 32 and crushing plate 40 installably removed therefrom, according to the preferred embodiment of the present invention.
Figure 6:
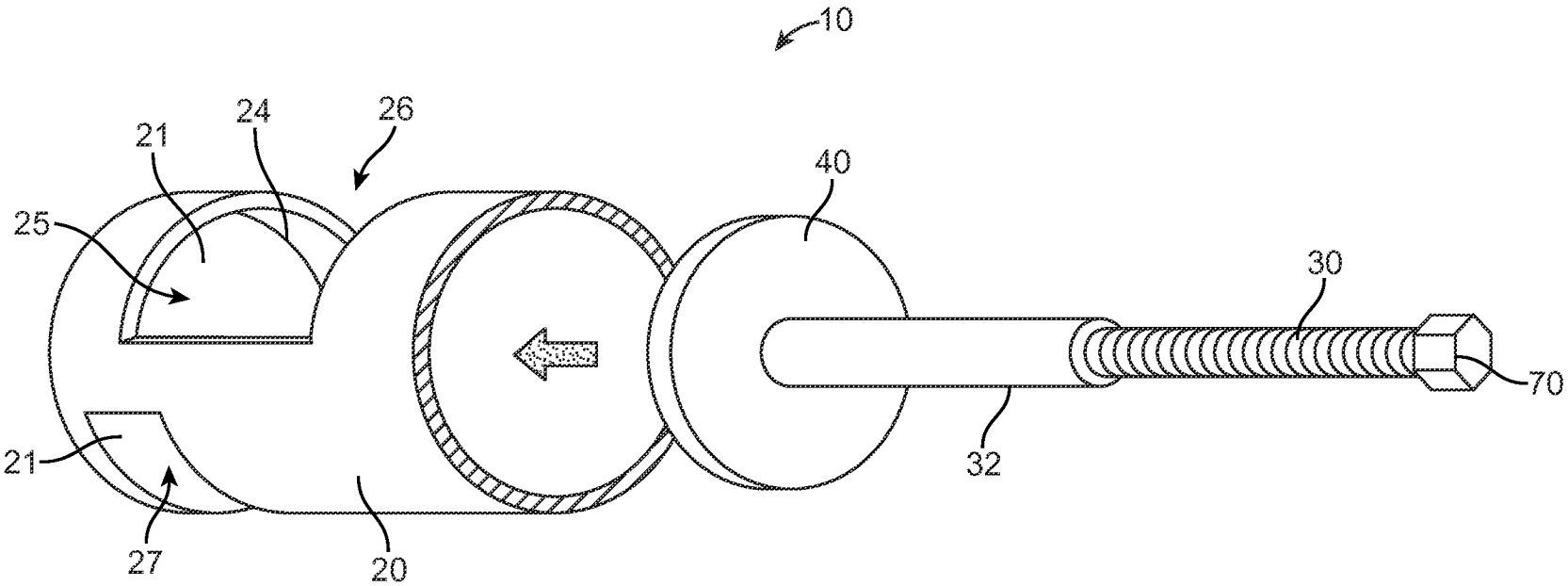

Referring now to FIGS. 4 through 6, views of the apparatus 10, are herein disclosed according to the preferred embodiment of the present invention. A threaded assembly of screw drive mechanisms 30, 32 is installed within the apparatus 10 to produce a linear mechanical action of the crushing plate 40 via rotational motion being applied through a power drill 60. The screw drive mechanisms 30, 32 are envisioned to take the form of a laterally stationary inner threaded rod 30 that spins upon activation of a power drill 60, thereby causing lateral motioning of a threadingly engaged outer screw drive mechanism 32 mounted thereupon said inner screw drive mechanism 30. Said inner screw drive mechanism 30 is rotated using a common power drill 60 affixed thereto the apparatus 10 via a power drill adapter 70 being integral to the inner screw drive mechanism 30. The outer screw drive mechanism 32 penetrates a fixed wall 22 having a guide hole 35 formed through. The outer screw drive mechanism 32 is fully supported through the guide hole 35 by which said outer screw drive mechanism 32 may motion to and fro. The outer screw drive mechanism 32 is guided at one (1) end via the guide hole portion 35 of the fixed wall 22 and is functionally adapted to remain horizontally stable via the inner screw drive mechanism 30 within. The threads on the inner screw drive mechanism 30 matingly engage the threads within the outer screw drive mechanism 32. In this way, rotation of the inner screw drive mechanism 30 motions said outer screw drive mechanism 32 linearly inward towards the chamber 25 and outward away from the chamber 25 dependent upon the direction of rotation being applied by the power drill 60.

The proximal end of the inner screw drive mechanism 30 comprises a power drill adapter 70, which allows a user to rotate said mechanism 30 with a standard power drill 60, as depicted in FIG. 4. The power drill 60 may be of any commonly known drills that receive its power from an electrical outlet or a rechargeable battery for example. The inner screw drive mechanism 30 is actuated via activation of a power drill 60 once said power drill 60 is in communication with a power drill adapter 70 through a chuck 65. The power drill adapter 70 extends from the rear of the apparatus 10 providing a non-slide contact for a chuck 65 of the power drill 60 to grip for rotation of the inner screw drive mechanism 30. The power drill 60 is then in communication with the inner screw drive mechanism 30 through the power drill adapter 70. The chuck 65 of the power drill 60 engages the power drill adapter 70 so that when the power drill 60 is activated, the rotational motion may be transferred to the power drill adapter 70 and consequently the inner screw drive mechanism 30.

The inner 30 and outer 32 screw drive mechanisms are installed in linear alignment with the longitudinal axis of the frame 20. The crushing plate 40 is generally flat vertical planar member which is functionally adapted to be integral with the outer screw drive mechanism 32. The crushing plate 40 comprises a first and second side, each essentially flat, and perpendicularly attached to the distal end of the outer screw drive mechanism 32. The first flat side of the crushing plate 40 is centrally integrated thereto the distal end of the outer screw drive mechanism 32. The second flat side of the crushing plate 40 is parallel thereto the first flat side and faces towards the chamber 25. The crushing plate 40 is integrally coupled to the distal end of the outer screw drive mechanism 32 such that upon actuation of said outer screw drive mechanism 32, the crushing plate 40 will advance against the top or bottom surface of the can 50 to a desired crushed length. When the outer screw drive mechanism 32 is motioned, a crushing plate 40 is driven either forwards or backwards depending on the rotational direction of the power drill 60. As the inner screw drive mechanism 30 is rotated in a direction, clockwise for example, said outer screw drive mechanism 32 may advance further inwardly within the chamber 25 and consequently advancing the crushing plate 40. The crushing plate 40 extends substantially perpendicular from the outer screw drive mechanism 32 so that the central position of said crushing plate 40 is collinear with the outer screw drive mechanism 32 which in turn is collinear with the central axis of the frame 20.

The shape of the internal walls 24 of the chamber 25 further assist in the guiding of the crushing plate 40 as it progresses through said chamber 25. The internal walls 24 of the frame 20 guides the crushing plate 40 as it motions, thus making the crushing operation easier and more controlled. Whenever the aluminum can 50 is placed within the chamber 25, said can 50 extends from a stationary wall 21 to the crushing plate 40 so that the longitudinal axis of the frame 20 is substantially perpendicular to the stationary wall 21 and crushing plate 40, as depicted in FIG. 4. The can 50 is placed within the chamber 25 so that the longitudinal axis of said frame 25 is preferably, but not essentially, aligned with the center of the crushing plate 40 and stationary wall 21. In addition, the outer screw drive mechanism 32 is integrally installed thereto the central location of the crushing plate 40 so that whenever said plate 40 engages the top or bottom surface of the can 50, the can 50 will efficiently be crushed without complication. The central position of the connection point of the outer screw drive mechanism 32 allows the crushing load to be equally distributed on the crushing plate 40. The crushing plate 40 transforms the rotational torque of the inner screw drive mechanism 30 as applied thereto the outer screw drive mechanism 32, to a crushing force that is then applied to the can 50. Thus, the central location of the outer screw drive mechanism 32 thereto the crushing plate 40 effectively distributes the crushing force thereto the can 50 to be crushed.

The crushing plate 40 is envisioned to be rigidly formed in a circular fashion with a diameter equal to the inner diameter of the chamber 25. The crushing plate 40 is envisioned to be relatively flat. Rubber or other materials may also be added to the outward surface of the crushing plate 40 to further enhance the frictional capability so that during the compression action, the can 50 may not slide, slip, or any other undesirable movement. The crushing plate 40 is generally flat vertical planar member which is functionally adapted to be integral with the outer screw drive mechanism 32 inside the frame 20 and parallel to the stationary wall 21 of the frame 20 via the outer screw drive mechanism 32. The stationary wall 21, integral with the frame 20, is similarly sized and shaped thereto the crushing plate 40. The stationary wall 21 is generally flat vertical planar wall which is functionally positioned at the opposing end to the crushing plate 40 so that said crushing plate 40 advances closer to said stationary wall 21. Alternatively, the stationary wall 21 may concave outwardly such as to provide a means for excess fluid and/or gases within the can 50 to be expelled from during the crushing operation. The coming together of these two (2) surfaces is what is providing the compression forces thereto the can 50. The crushing plate 40 advances towards the stationary wall 21 during crushing and motions away from said stationary wall 21 once the crushing action is complete.

The power drill 60 is attached to a power drill adapter 70 to initiate motion of the inner screw drive mechanism 30 to advance a crushing plate 40 to crush the can 50. Upon successful crushing of the can 50, the direction of rotation of the power drill 60 may then be reversed and therefore withdraw the crushing plate 40 thereby allowing the crushed can 50 to fall through the dispensing aperture 27, as is depicted in FIG. 5, and may then be disposed as desired. The sides of the can 50 will not present any sharp edges that may have been formed from the crushing operation by containment of such protrusions within the chamber 25 during the compression operation. The internal walls 24 of the frame 20 prevent the can 50 from protruding outwardly, thus creating sharp edges. Instead, the can 50 implodes inwardly. The dispensing aperture 27 further allows any superfluous liquids to depart from the chamber 25 for easy cleaning.

An alternate embodiment of the present invention may disclose a closable door that may further contain the contents in the chamber 25. The door may be hingable to the frame 20 to allow access therein the frame 20 for the insertion of the cans 50 through the can insertion aperture 26 and may then be closed prior to the crushing operation for further containment of the can 50. The door may be beneficial for safety as well to prevent access to pinch points within the chamber 25.

Another alternate embodiment of the present invention may disclose a crushing plate 40 and/or stationary wall 21 that may concave outwardly slightly so as to allow any excess fluids and/or gases from within the can 50 to be expelled as said can 50 is being crushed. During crushing of the can 50, air and residual fluid inside the can 50 may expel outwardly through the interface of the can rim and the stationary wall 21 or crushing plate 40.

The preferred embodiment of the present invention can be utilized by the common user in a simple and effortless manner with little or no training. After initial purchase or acquisition of the apparatus 10, it would be configured as indicated in FIGS. 1 thru 6. The apparatus 10 is adapted for crushing cans 50 such as aluminum beverage cans 50 by being removably installed thereto a power drill 60 or the like via a power drill adapter 70. To begin compression of an installed aluminum can 50, a user may simply follow these instructions:

In application, a user positions the crushing plate 40 in the rearmost position within the frame 20 via utilization of the reverse direction of the power drill 60, i.e. counterclockwise rotation. A typical twelve ounce (12 oz.) aluminum can 50 is situated within the chamber 25 through use of the can insertion aperture 26 formed between the stationary wall 21 and the crushing plate 40. With the aluminum can 50 located between the crushing plate 40 and the stationary wall 21 in the chamber 25, the user may then attach the power drill 60 to the power drill adapter 70 via the chuck 65 of said power drill 60. Once installment has been accomplished, the user may simply rotate the drill 60 in a certain direction, i.e. clockwise, to motion the crushing plate 40 forward. As the power drill adapter 70 rotationally motions, the inner screw drive mechanism 30 begin to rotate within the outer screw drive mechanism 32 allowing said outer screw drive mechanism 32 advance. In this fashion, the aluminum can 50 is enclosed by the internal side walls 24 of the frame 20, the stationary wall 21, and the crushing plate 40 by which said can 50 is less inclined to slip, slide, or any other undesirable motion from within the chamber 25, which insures proper functioning of the apparatus 10. As the power drill adapter 70, and consequently the inner screw drive mechanism 30, continues to rotate, the crushing plate 40 continues to be motioned inwardly towards the stationary wall 21 within the chamber 25 until the can 50 is fully crushed. The power drill's 60 rotation may then be reversed and consequently reversing the rotation of the inner screw drive mechanism 30 which in turns linearly progresses the outer screw drive mechanism 32 and the crushing plate 40 away from the stationary wall 21, and consequently the crushed can 50. This reversal motion causes the crushed can 50 to fall therethrough the dispensing aperture 27 preferably into a trash bin, recycling bin, or other disposal means without the need for handling the crushed can 50. The apparatus 10 is thus ready for the compression of yet another can 50 or the power drill 60 may then be disengaged from the power drill adapter 70 of the apparatus 10 whenever the crushing of cans 50 is complete.

The power drill 60 is actuated to begin the compression response where the crushing plate 40 is driven inwards by the outer screw drive mechanism 32. As rotation initiates, the inner screw drive mechanism 30 causes the outer screw drive mechanism 32 to advance linearly forward to motion the crushing plate 40 towards the chamber 25. The frame 20 comprises a hollow cylindrical structure having an inner chamber 25 with a circular cross section having a diameter sized to contain a standard aluminum can 50. The chamber 25 comprises an inner circular defining wall surface 24 being a selected size such that the internal walls 24 outlining the chamber 25 will guide the crushing plate 40 as motion is being applied via utilization of the power drill 60. The internal walls 24 of the chamber 25 also constrict any undesirable outward expansion of a crushing can 50. During the crushing operation, the can 50 is crushed inward via the equal crushing load being applied via the crushing plate 40 while the outside walls of said can 50 is contained via the internal walls 24 of the chamber 25 until the can 50 is fully crushed. The rotation of the power drill 60 may then be reversed to bring the crushing plate 40 away from the can 50 to allow gravity to pull the crushed can 50 through the dispensing aperture 27.

The fixed wall 22 is configured with a guide hole 35 through which matingly engages the outer screw drive mechanism 32 which is intended to pass, as depicted in FIG. 6. The inner screw drive mechanism 30 is threadingly engaged and aligned with the outer screw drive mechanism 32 within the frame 20 such said outer screw drive mechanism 32 may advance and retract upon rotational activation of the power drill 60. The threads of the inner screw drive mechanism 30 engages the threads of the outer screw drive mechanism 32 so that upon rotation of the inner screw drive mechanism 30, the outer screw drive mechanism 32 advances or retracts dependent upon the rotation of the power drill 60. The outer screw drive mechanism 32 drives the crushing plate 40, thereby causing the crushing plate 40 to motion linearly in a predetermined path towards and away from the chamber 25. The power drill 60 can apply torque to the inner screw drive mechanism 30 which transfers to the outer screw drive mechanism 32 and the crushing plate 40 during the crushing operation to apply force onto the can 50. The can 50 is supported by the chamber 25 of the frame 20 and once crushed, will fall through the dispensing aperture 27.

As the can 50 is crushed by the linear movement of the crushing plate 40, the internal surface walls 24 of the chamber 25 restrain the outward expansion of the can 50 so that the can 50 is forced to expand inwardly rather than outwardly to minimize the number of sharp edges in the can 50. The construction of the frame 20 is such that it will be strong enough to restrain a can 50 especially during the compression operation. As illustrated, the frame 20 desirably has a length greater than a commonly known twelve ounce (12 oz.) can 50 with a chamber 25 that is dimensionally sized to contain an inside diameter slightly greater than the outside diameter of said can 50 so as to contain and restrain a can 50 while it is being crushed without difficulty.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A power drill operated can crusher comprising:

a frame adapted to contain a can therein;

a crushing plate positioned in said frame;

inner and outer screw drive mechanisms installed in linear alignment with a longitudinal axis of said frame; and, a power drill adaptor connected directly to one end of said inner screw mechanism, said power drill adapter being adapted to be rotated by an existing power drill;

wherein said crushing plate transforms a rotational torque of said inner and outer screw drive mechanisms to a crushing force along the longitudinal axis of said frame, said crushing plate connected directly to one end of said outer screw mechanism;

wherein said inner screw drive mechanism is threadably inserted into said outer screw drive mechanism;

wherein said outer screw drive mechanism rotatably travels about an outer surface of said inner screw drive mechanism;

wherein said frame includes:

a stationary wall disposed perpendicularly to the longitudinal axis of said frame;

a fixed wall having a centrally located guide hole;

an insertion aperture adapted to receive the can; and, a dispensing aperture adapted to dispense the can;

wherein said insertion aperture has proximal and distal curvilinear edges each intermediately located between said stationary wall and said fixed wall;

wherein said dispensing aperture has a distal curvilinear edge distally spaced from said distal curvilinear edge of said insertion aperture relative to said fixed wall;

wherein said frame has an outer shoulder extending from said distal curvilinear edge of said insertion aperture to said stationary wall; and, wherein said distal curvilinear edge of said insertion aperture is spaced from said stationary wall.

2. The power drill operated can crusher of claim 1, wherein said frame comprises:

a chamber having an internal wall;

wherein said internal wall is adapted to contain and guide the can along the longitudinal axis during a can crushing procedure.

3. The power drill operated can crusher of claim 1, wherein said crushing plate comprises: a planar member having a diameter equal to an inner diameter of said chamber, said planar member having first and second flat sides perpendicularly attached to a distal end of said outer screw drive mechanism;

wherein said first flat side is centrally integrated to said distal end of said outer screw drive mechanism;

wherein said second flat side is oriented parallel to said first flat side and faces said chamber;

wherein said crushing plate is coupled to said distal end of said outer screw drive mechanism such that actuation of said outer screw drive mechanism linearly advances said crushing plate along said frame; and, wherein a central portion of said crushing plate is collinear with said outer screw drive mechanism that is collinear with the longitudinal axis of said frame.

4. The power drill operated can crusher of claim 1, wherein said inner screw drive mechanism comprises: an inner rod adapted to rotate upon activation of the existing power drill;

wherein said outer screw drive mechanism is threadably engaged with said inner rod of said inner screw drive mechanism; and, wherein said inner and outer drive mechanisms linearly displace said crushing plate when a rotational motion is applied by the existing power drill.

5. The power drill operated can crusher of claim 1, wherein a clockwise rotation of said inner screw drive mechanism motions said outer screw drive mechanism linearly inward towards said chamber;

wherein a counterclockwise rotation of said inner screw drive mechanism motions said outer screw drive mechanism linearly outward away from said chamber respectively.

6. The power drill operated can crusher of claim 2, wherein said stationary wall has a planar top surface with curvilinear circumferential edge for expelling fluid through said dispensing aperture.

7. The power drill operated can crusher of claim 2, further comprising: a closable door hingedly connected to said frame and covering said insertion aperture.

8. A power drill operated can crusher comprising:

a frame adapted to contain a can therein;

a crushing plate positioned in said frame and disposed perpendicularly to a longitudinal axis of said frame;

inner and outer screw drive mechanisms installed in linear alignment with the longitudinal axis of said frame; and, a power drill adaptor connected directly to one end of said inner screw mechanism, said power drill adapter being adapted to be rotated by an existing power drill;

wherein said crushing plate transforms a rotational torque of said inner and outer screw drive mechanisms to a crushing force along the longitudinal axis of said frame said crushing plate connected directly to one end of said outer screw mechanism;

wherein said inner screw drive mechanism is threadably inserted into said outer screw drive mechanism;

wherein said outer screw drive mechanism rotatably travels about an outer surface of said inner screw drive mechanism;

wherein said frame includes:

a stationary wall disposed perpendicularly to the longitudinal axis of said frame;

a fixed wall having a centrally located guide hole;

an insertion aperture adapted to receive the can; and, a dispensing aperture adapted to dispense the can;

wherein said insertion aperture has proximal and distal curvilinear edges each intermediately located between said stationary wall and said fixed wall;

wherein said dispensing aperture has a distal curvilinear edge distally spaced from said distal curvilinear edge of said insertion aperture relative to said fixed wall;

wherein said frame has an outer shoulder extending from said distal curvilinear edge of said insertion aperture to said stationary wall; and, wherein said distal curvilinear edge of said insertion aperture is spaced from said stationary wall.

9. The power drill operated can crusher of claim 8, wherein said frame comprises:

a chamber having an internal wall;

wherein said internal wall is adapted to contain and guide the can along the longitudinal axis during a can crushing procedure.

10. The power drill operated can crusher of claim 8, wherein said crushing plate comprises: a planar member having a diameter equal to an inner diameter of said chamber, said planar member having first and second flat sides perpendicularly attached to a distal end of said outer screw drive mechanism;

wherein said first flat side is centrally integrated to said distal end of said outer screw drive mechanism;

wherein said second flat side is oriented parallel to said first flat side and faces said chamber;

wherein said crushing plate is coupled to said distal end of said outer screw drive mechanism such that actuation of said outer screw drive mechanism linearly advances said crushing plate along said frame; and, wherein a central portion of said crushing plate is collinear with said outer screw drive mechanism that is collinear with the longitudinal axis of said frame.

11. The power drill operated can crusher of claim 8, wherein said inner screw drive mechanism comprises: an inner rod adapted to rotate upon activation of the existing power drill;

wherein said outer screw drive mechanism is threadably engaged with said inner rod of said inner screw drive mechanism; and, wherein said inner and outer drive mechanisms linearly displace said crushing plate when a rotational motion is applied by the existing power drill.

12. The power drill operated can crusher of claim 8, wherein a clockwise rotation of said inner screw drive mechanism motions said outer screw drive mechanism linearly inward towards said chamber;

wherein a counterclockwise rotation of said inner screw drive mechanism motions said outer screw drive mechanism linearly outward away from said chamber respectively.

13. The power drill operated can crusher of claim 9, wherein said stationary wall has a planar top surface with curvilinear circumferential edge for expelling fluid through said dispensing aperture.

14. The power drill operated can crusher of claim 9, further comprising: a closable door hingedly connected to said frame and covering said insertion aperture.

15. A method of utilizing a power drill operated can crusher, said method comprising the steps of:

providing a frame;

positioning a can within said frame;

providing and positioning a crushing plate in said frame;

disposing said crushing plate perpendicularly to a longitudinal axis of said frame;

providing and installing inner and outer screw drive mechanisms in linear alignment with the longitudinal axis of said frame;

providing and connecting a power drill adaptor directly to one end of said inner screw mechanism;

connecting said power drill adaptor to an existing power drill; and, operating the existing power drill and thereby rotating said power drill adaptor;

said crushing plate transforming a rotational torque of said inner and outer screw drive mechanisms to a crushing force along the longitudinal axis of said frame and thereby crushing the can;

wherein said inner screw drive mechanism is threadably inserted into said outer screw drive mechanism;

wherein said outer screw drive mechanism rotatably travels about an outer surface of said inner screw drive mechanism;

wherein said frame includes:

a stationary wall disposed perpendicularly to the longitudinal axis of said frame;

a fixed wall having a centrally located guide hole;

an insertion aperture adapted to receive the can; and, a dispensing aperture adapted to dispense the can;

wherein said insertion aperture has proximal and distal curvilinear edges each intermediately located between said stationary wall and said fixed wall;

wherein said dispensing aperture has a distal curvilinear edge distally spaced from said distal curvilinear edge of said insertion aperture relative to said fixed wall;

wherein said frame has an outer shoulder extending from said distal curvilinear edge of said insertion aperture to said stationary wall; and, wherein said distal curvilinear edge of said insertion aperture is spaced from said stationary wall.

* * * * *